US006780052B2

(12) United States Patent
Montena et al.

(10) Patent No.: US 6,780,052 B2
(45) Date of Patent: Aug. 24, 2004

(54) COMPRESSION CONNECTOR FOR COAXIAL CABLE AND METHOD OF INSTALLATION

(75) Inventors: Noah Montena, Syracuse, NY (US); Stephen Malak, Manlius, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/309,677

(22) Filed: Dec. 4, 2002

(65) Prior Publication Data

US 2004/0110416 A1 Jun. 10, 2004

(51) Int. Cl.[7] ..... H01R 9/05
(52) U.S. Cl. ..... 439/578
(58) Field of Search ..... 439/578, 582–585

(56) References Cited

U.S. PATENT DOCUMENTS

| | | | |
|---|---|---|---|
| 3,644,874 | A | 2/1972 | Hutter |
| 3,673,547 | A | 6/1972 | Ziegler, Jr. |
| 3,778,535 | A | 12/1973 | Forney, Jr. |
| 4,131,332 | A | 12/1978 | Hogendobler et al. |
| 4,377,320 | A | 3/1983 | Lathrop et al. |
| 4,408,822 | A | 10/1983 | Nikitas |
| 4,795,370 | A | 1/1989 | Freitag |
| 5,137,471 | A | 8/1992 | Verespej et al. |
| 5,295,864 | A | 3/1994 | Birch et al. |
| 5,607,325 | A | 3/1997 | Toma |
| 5,667,405 | A | 9/1997 | Holliday |
| 5,785,554 | A | 7/1998 | Ohshiro |
| 5,857,865 | A | 1/1999 | Shimirak et al. |
| 5,877,452 | A | 3/1999 | McConnell |
| 5,975,951 | A | 11/1999 | Burris et al. |
| 5,984,723 | A | 11/1999 | Wild |
| 5,997,350 | A | 12/1999 | Burris et al. |
| 6,089,913 | A | 7/2000 | Holliday |
| D436,076 | S | 1/2001 | Montena |
| 6,210,222 | B1 | 4/2001 | Langham |
| 2001/0034159 | A1 | 10/2001 | Pitschi |

*Primary Examiner*—Renee Luebke
*Assistant Examiner*—Ann McCamey
(74) *Attorney, Agent, or Firm*—Wall Marjama & Bilinski, LLP; James R. Muldoon

(57) ABSTRACT

An F connector for mounting to the prepared end of a coaxial cable by compression of portions of the connector into tight frictional engagement with the cable. The body and compression ring of the usual F connector are incorporated in a unitary, one-piece body having three axial sections. The first section surrounds and frictionally engages the outer surface of the post stem in the usual manner. The second section is spaced from the stem to provide an annular space for the shielding and outer dielectric layers of the cable, also in the usual manner. A third section of the body is joined to the second section by an area of reduced thickness. In a first disclosed embodiment, the body fractures at the area of reduced thickness in response to an axial force applied to the third section in the direction of the second section. The wall thickness of the third section tapers outwardly from the area of reduced thickness, whereby movement of the third section between the inner surface of the second section and the outer surface of the cable by the axial force subsequent to fracture applies a radially compressive force to the cable and provides the desired tight frictional engagement of the connector and cable. In a second embodiment, the third section includes two, axially spaced areas of reduced thickness. The portions of the third section adjacent these reduced thickness areas are folded into the area between the second section and the cable as the axial force is applied, rather than being fractured.

33 Claims, 6 Drawing Sheets

COMPRESSION CONNECTOR FOR COAXIAL CABLE AND METHOD OF INSTALLATION

BACKGROUND OF THE INVENTION

The present invention relates to connectors for installation on a terminal end of a coaxial cable as used, for example, in CATV applications by radial compression of the cable by a deformable body portion of the connector. More specifically, the invention relates to compression-type connectors wherein the number of parts is reduced and manner of effecting compression is different from conventional, prior art connectors of this type.

A common type of connector installed on a terminal end of a coaxial cable includes elements known as a post, a nut, a body and a compression ring. The post includes a hollow stem integrally joined at one end to a flange. The nut is rotatably secured to the post, typically at or near the junction of the stem and flange, and the body surrounds the stem with a first portion, near the nut, in frictional engagement therewith and a second portion in outwardly spaced relation thereto. The compression ring, a hollow, substantially cylindrical member, is initially maintained in engagement with the body by one end of the ring encircling the end of the body remote from the nut. The end of the coaxial cable is prepared by stripping away certain layers thereof at specified distances from the end of the central conductor. After the cable is "prepped" the connector is installed by inserting the cable axially into the connector with the stem of the connector post being forced between the outer layer of conducting material and the woven mesh metallic shielding layer. The shielding layer and the outer dielectric layer are in the initially open, annular space between the stem and inner surface of the body. Installation is completed by axial movement of the compression ring over the body with tapered surfaces on one or both of these members causing radial compression of the body into tight, frictional engagement with the outer surface of the coaxial cable.

The prior art includes, of course, a wide variety of styles and configurations of compression connectors of this general type. A feature common to radial compression connectors, however, is the separate fabrication of the body and compression ring which provide the means of frictionally engaging the connector with the cable. A variation of this design is disclosed in U.S. Pat. No. 5,525,076 of Down wherein the connector body includes one or more grooves extending into and around its outer surface. As the body is axially compressed, a portion of the body wall at the groove(s) is forced radially inwardly, into the outer dielectric layer of the coaxial cable. This forms a moisture barrier around the surface of the cable and mechanically locks the connector and cable, but does not radially compress the body into tight frictional engagement with the cable in the manner of the prior art connectors alluded to above and the present invention.

It is a principle object of the present invention to provide a novel and improved coaxial cable connector of the radial compression type which requires fewer parts than typical prior art connectors of the same general type, thereby offering advantages normally associated with a reduction in part count of multi-element devices.

It is a further object to provide a connector which is mounted to an end portion of a coaxial cable by a novel method of operation.

It is another object to provide novel and improved means for mounting a connector to the end of a coaxial cable.

Other objects will in part be obvious and will in part appear hereinafter.

SUMMARY OF THE INVENTION

In furtherance of the foregoing objects, the invention contemplates a connector having an essentially conventional post and nut in combination with a novel body. The post has the usual, integral flange and stem portions and the nut is rotatably engaged with the post at the flanged end. The hollow body includes a first portion extending axially from a first end and having an inner diameter substantially corresponding to the outer diameter of the post stem, a second portion extending axially from the first portion and having a larger inner diameter, and a third portion extending axially from the second portion to a second end. The three portions are integrally formed as a single, molded part. In a first disclosed embodiment, the third portion is connected to the second portion by a wall section of reduced thickness. The third portion is of the same inner diameter as the second portion and tapers to a larger outer diameter from the position of smallest wall thickness toward the second end of the body. When the connector is installed on the cable, the stem extends between the metal shielding layer of the cable and the outer conducting layer in the usual manner with these two layers positioned in the space between the outside of the stem and inside of the second body portion. When an axial force is applied (by an appropriate tool) to the third body portion, tending to move it in the direction of the first portion, the wall fractures at the section of smallest thickness, allowing the third section to be forced between the second section and the outer surface of the coaxial cable. The tapered surface on the third section is wedged between the second section and the cable surface, thereby radially compressing the cable and causing tight frictional engagement of the connector and cable.

In a second embodiment, the third section of the body has two annular areas of reduced cross section, axially spaced from one another. The thickness of these sections is such, relative to the type and characteristics of the material from which the body is fabricated, that as axial force is applied to the third section, tending to move it in the direction of the second section, that the wall folds at both areas of reduced cross section. Thus, rather than fracturing the body wall, as in the first embodiment, the body remains in a single part, but with folded layers of the third body portion between the inner surface of the second body portion and the outer surface of the cable, producing tight frictional engagement of the connector and the cable.

The features of the invention generally described above will be more readily apparent and fully appreciated from the following detailed description, taken in conjunction with the accompanying drawings.

DETAILED DESCRIPTION

Figure 1:
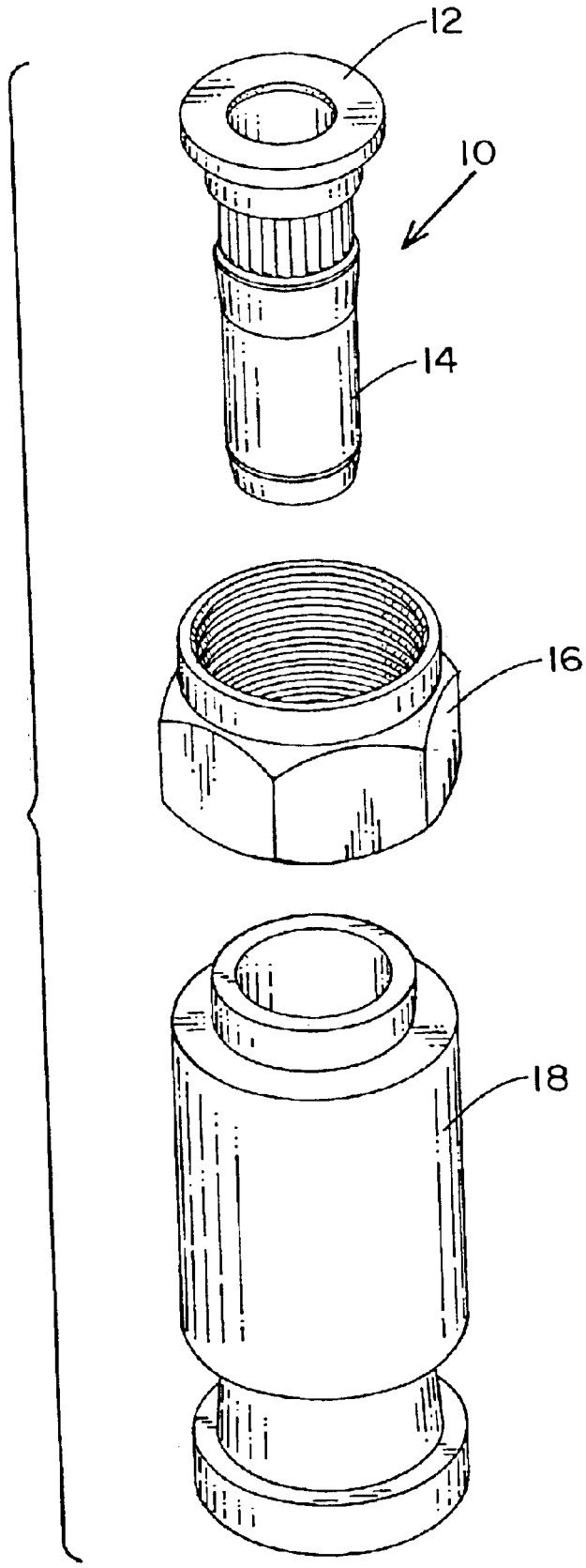
FIG. 1 is an exploded, perspective view of the cable connector of the invention, shown in a first embodiment.
Figure 2:
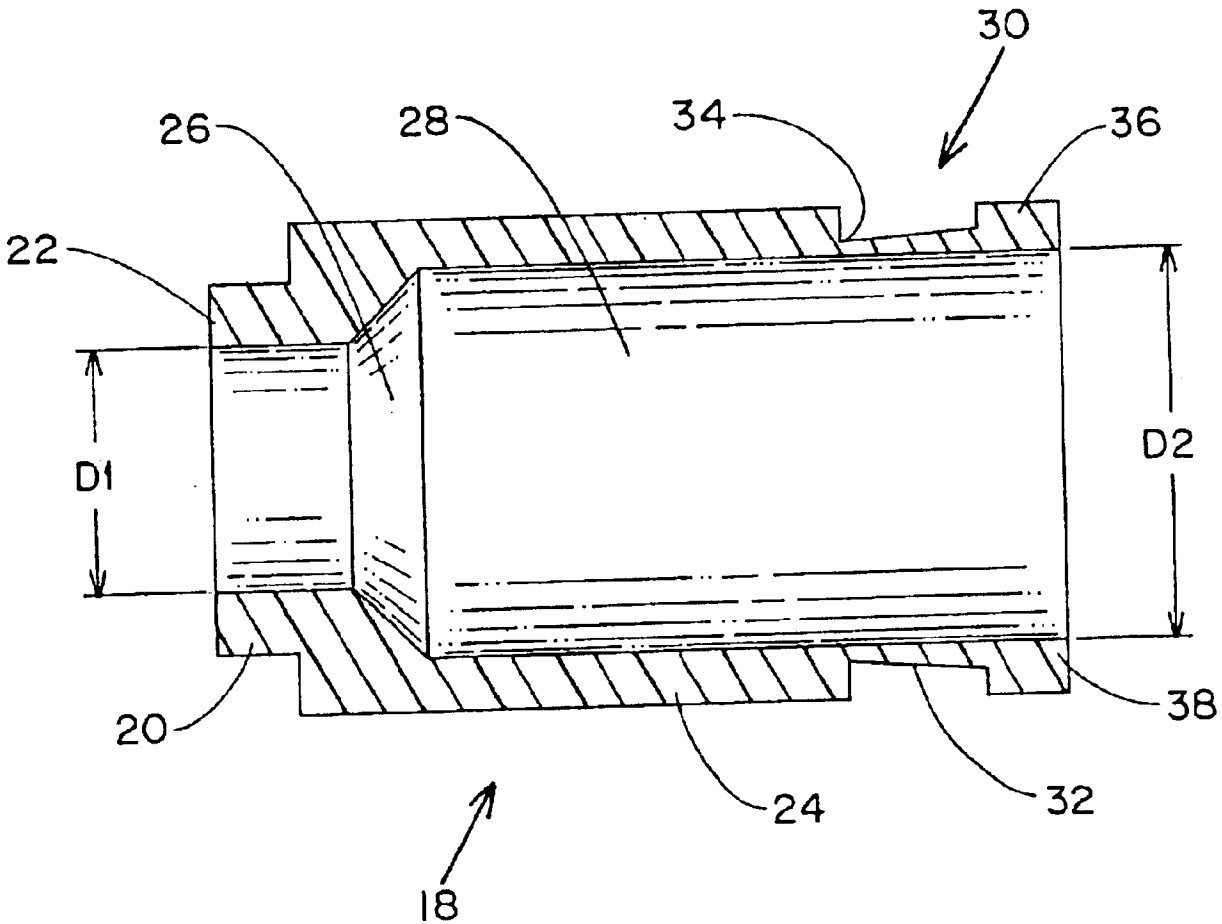
FIG. 2 is a front elevational view of one of the elements of FIG. 1 in full section.

Referring now to the drawings, in FIG. 1 are shown the three components of the connector, namely, post 10, including integrally formed flange 12 and stem 14 sections, nut 16 and body 18. Post 10 and nut 16 are of conventional construction for use in this type of coaxial cable connector, body 18 being of unique construction, shown in a first embodiment in FIGS. 1–3. Body 18 is shown in cross section in FIG. 2 where it will be noted that the body includes three sections, integrally formed as a single piece. The first section 20 extends axially from one end 22 of body 18 for a portion of its axial length having inner diameter D1. Second section 24 includes tapered portion 26, connecting inner diameter D1 with larger inner diameter D2 of constant diameter portion 28 second section 24. Third section 30 extends integrally from second section 24 with the same inner diameter, but with a wall portion 32 of reduced thickness. The smallest thickness of wall portion 32 is at its juncture with second section 24, denoted by reference numeral 34, from which the outer surface of third section 30 tapers outwardly at a relatively small angle to wall portion 36 which has the same outer diameter as second section 24.and extends to the other end 38 of body 18. The three parts of the connector are mutually assembled by passing stem 14 through the opening defined by internal flange 17 (see FIG. 3) of nut 16, followed by passing the stem through first section 20 of body 18 until end 22 abuts larger diameter portion 15 of stem 14. Flange 17 is thus axially engaged between flange 12 of post 10 and end 22 of body 18 with nut 16 being freely rotatable with respect to post 10 and body 18.

Figure 3:
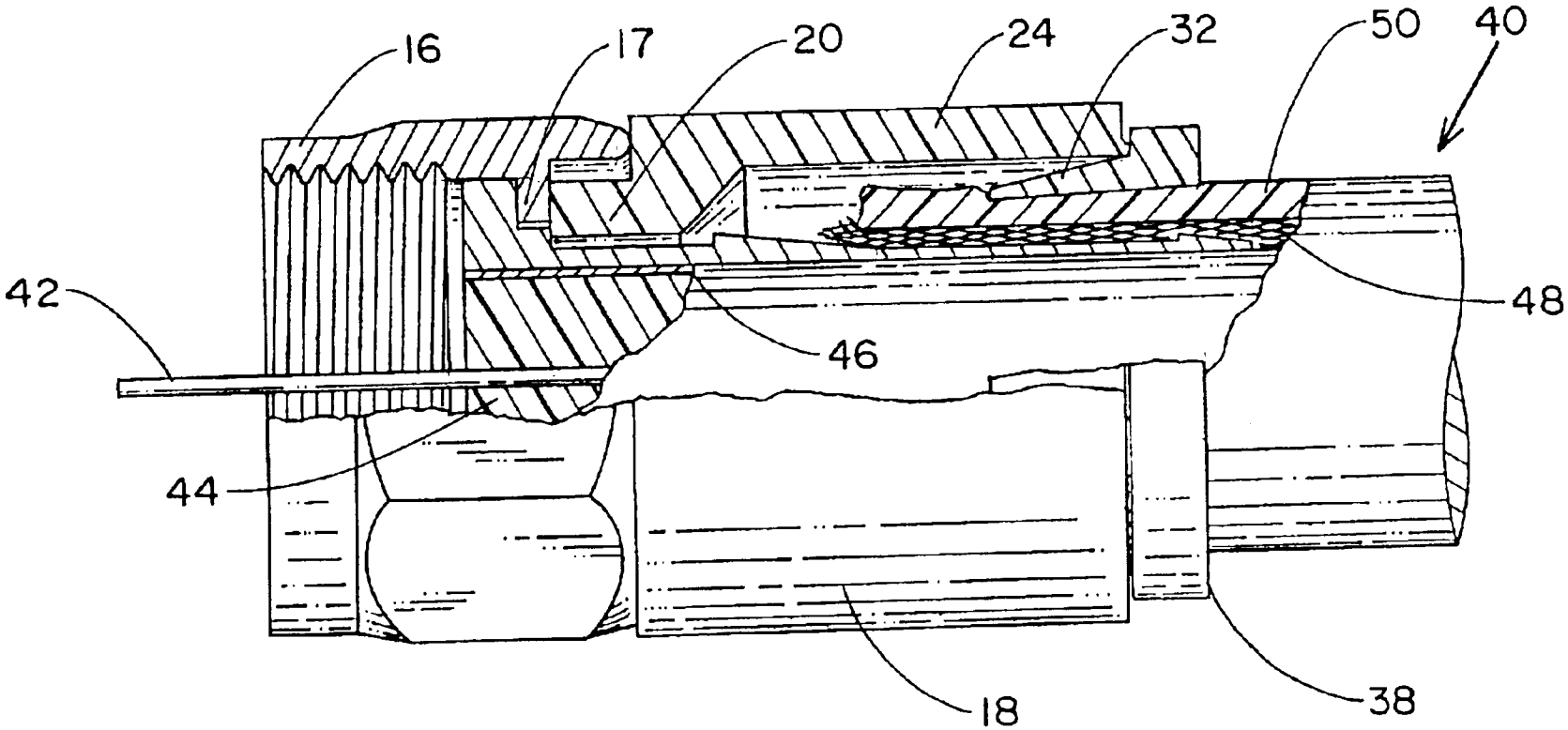
FIG. 3 is a front elevational view of the connector of FIG. 1 mounted to a conventional coaxial cable with portions of both the connector and cable broken away to be seen in section.

The connector is shown in FIG. 3 in assembled relation with an end portion of a conventional coaxial cable, denoted generally by reference numeral 40 and having inner conductor 42 surrounded by inner layer 44 of dielectric material, layer 46 of conducting material, shielding layer 48 in woven mesh form, and outer layer 50 of dielectric material. After the end of the cable has been prepped in the specified (conventional) manner, it is inserted axially into end 38 of body 18 and advanced until the exposed end surfaces of layers 44 and 46 are substantially flush with the end surface of flange 12. During this relative movement of the cable and connector, stem 14 is forcibly inserted between cable layers 46 and 48, as is also conventional in the mounting of F connectors upon coaxial cables. The connector is then engaged by a compression tool (not shown) in order to apply an axial force tending to move second and third section 24 and 30 in opposite directions, i.e., toward one another. Upon application of sufficient force in this manner, body 18 fractures about its periphery at the smallest thickness of wall section 32, i.e., at the juncture of second and third sections 24 and 30, respectively, denoted in FIG. 2 by reference numeral 34. After fracturing, body 18 is in two pieces and continued application of axial force moves wall portion 32 between the inner surface of second section 24 and the outer surface of cable dielectric layer 50. The outward taper of the outer surface of wall portion 32 results in radial compression of cable 40 and tight frictional engagement of the connector and cable, as shown in FIG. 3.

Figure 4:
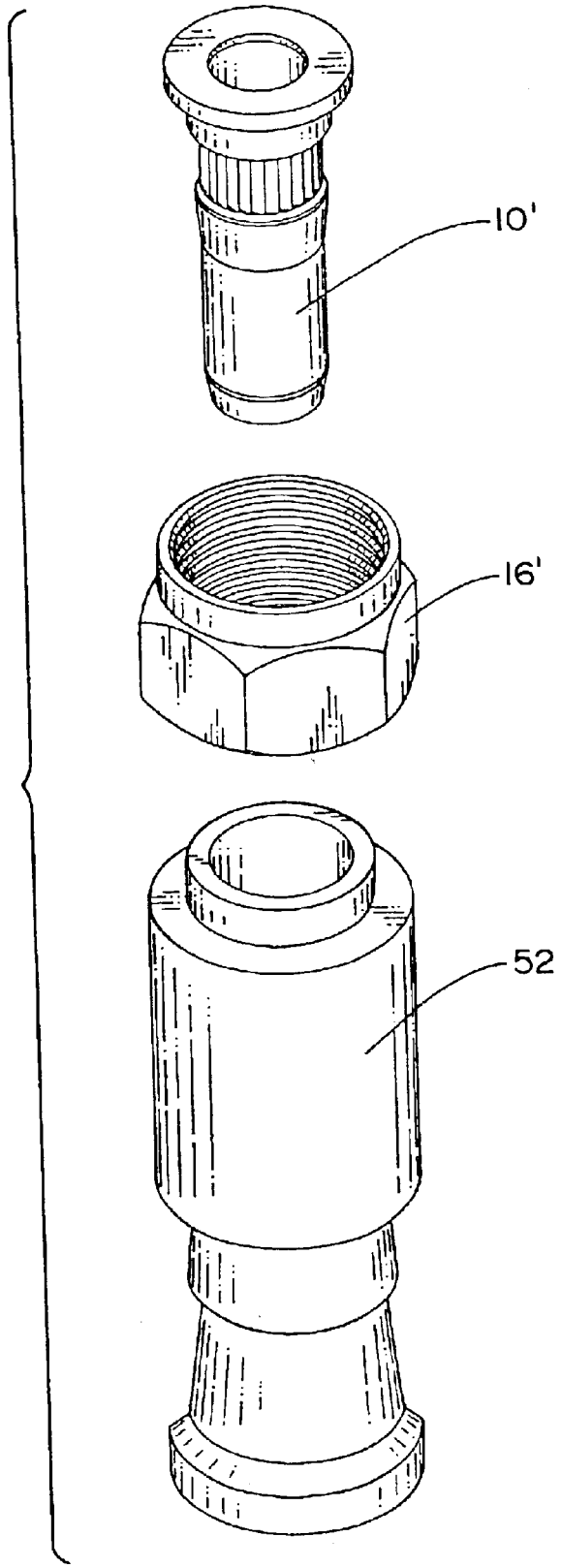
FIG. 4 is an exploded, perspective view of the cable connector of the invention, shown in a second embodiment.
Figure 5:
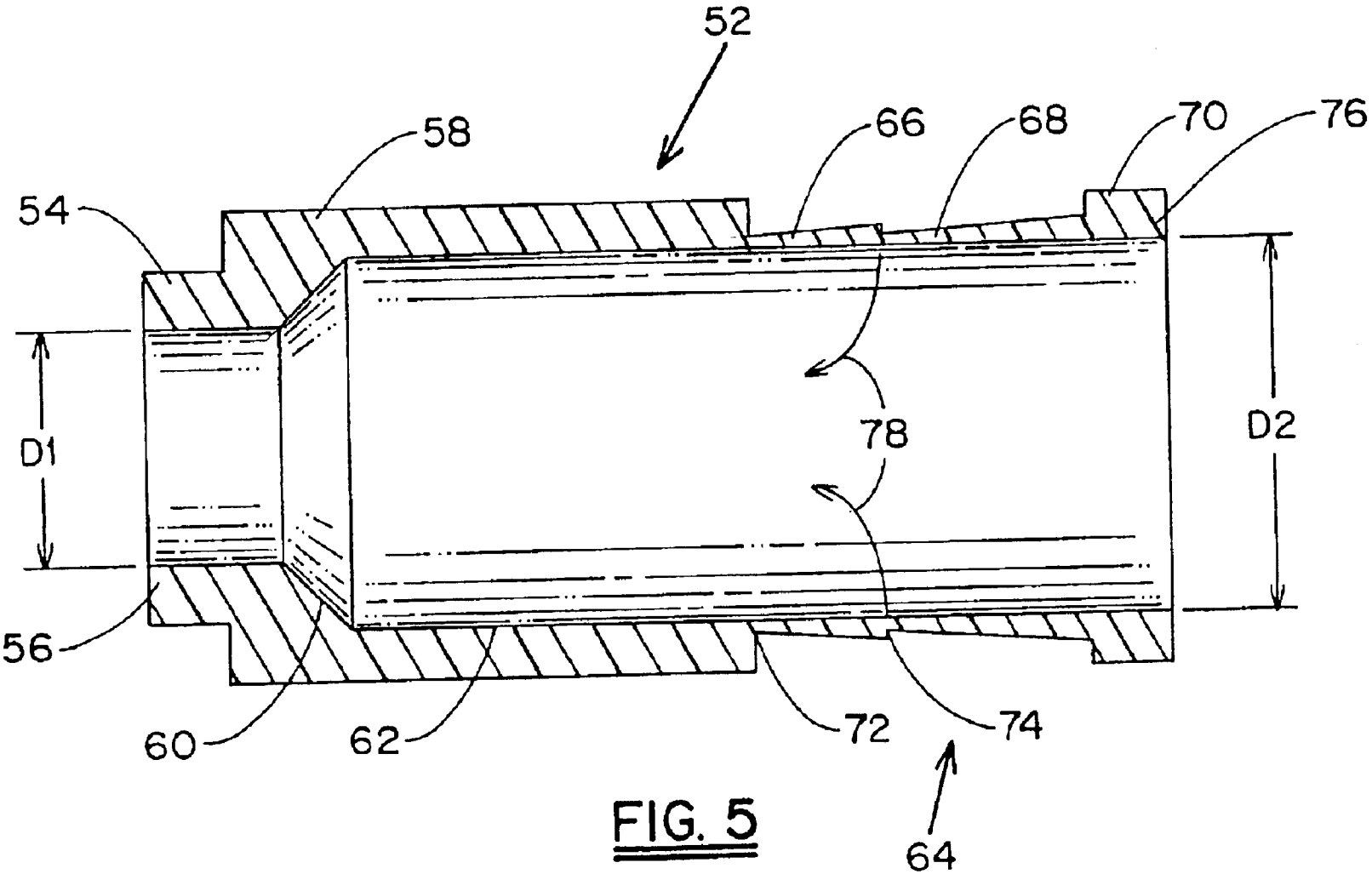
FIG. 5 is a front elevational view of one of the elements of FIG. 4 in full section.
Figure 6:
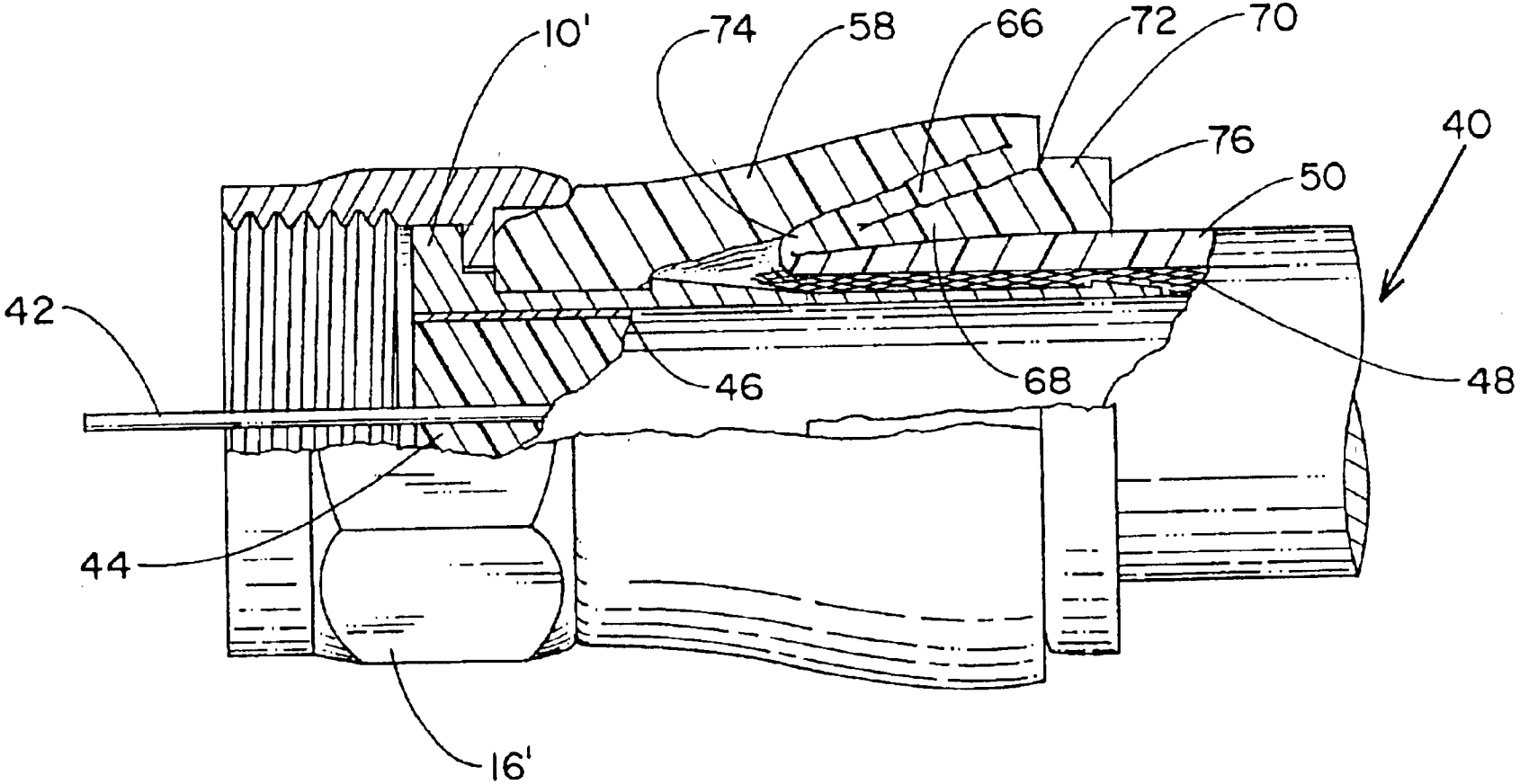
FIG. 6 is a front elevational view of the connector of FIG. 4 mounted to a conventional coaxial cable with portions of both the connector and cable broken away to be seen in section.

Turning now to FIGS. 4–6, the connector is shown with a second embodiment of body, denoted by reference numeral 52, in combination with the conventional post and nut,here denoted by numerals 10' and 16', respectively. Body 52, as best seen in the sectional view of FIG. 5, again includes first section 54, extending from one end 56 of the body for the axial length thereof having inner diameter D1, second section 58, having tapered inner surface portion 60 connecting diameter D1 with larger inner diameter D2 of constant diameter portion 62 of second section 58. In this embodiment, third section 64 includes first, second and third wall portions 66, 68 and 70, respectively. First portion 66 extends from the junction of second and third sections 58 and 64, respectively, at a first area 72 of reduced thickness, tapering outwardly to its juncture with second portion 68 at a second area 74 of reduced thickness. Second portion 68 tapers outwardly to its junction with third portion 70 which extends to the other end 76 of body 52. Third section 64 is of constant inner diameter D2 throughout its length and is of smaller outer diameter over both portions 66 and 68 than second section 58, the outer diameter of third wall portion 70 being equal to that of second section 58.

Body 52 differs from body 18 not only in the use of an additional wall portion in the third section, but also in the material used and the manner of operation. Body 18 is preferably of a quite rigid plastic which also exhibits a degree of brittleness, whereby the material fractures at the peripheral line of smallest thickness and axial movement of the tapered portion between the second body portion and the cable radially compresses the cable with little if any outward radial movement of the body. Body 52, on the other hand, is made of a more flexible, elastic material. When axial force is applied with a compression tool, rather than fracturing, first wall portion 66 folds inwardly about the periphery of reduced thickness area 72, causing the periphery at reduced thickness area 74 to move in the direction of arrows 78. After movement of portion 66 substantially 180o, into contact with the inner surface of second section 58, wall section 68 has moved into surface-to-surface contact with wall section 66, as shown in FIG. 6 which also includes the coaxial cable with common reference numerals denoting the same parts thereof as in FIG. 3. The axial force producing the folding action of wall portions 66 and 68 is applied, of course, after the cable has bee inserted into the connector. Consequently, the outer surface of the cable stands in the way of the inner movement of wall section 66, as indicated by arrows 78 in FIG. 5. The flexible nature of body 52 permits outward, flexing movement of second section 58 as inward movement of section 66 begins and inward contraction thereof as the folding is completed. The combined thickness of wall sections 66 and 68 The thickness in areas 72 and 74 are established as a function of the properties of the material of body 52 to provide the desired folding action upon application of axial force tending to move third section 64 toward second section 58.

What is claimed is:

1. A connector for mounting to an end portion of a coaxial cable, said connector comprising:

a) a threaded nut;

b) a hollow post having integral flange and stem portions, said stem having a predetermined outer diameter over at least an axial portion adjoining said flange;

c) means for rotatably securing said nut to said post;

d) a hollow, one piece body of predetermined material having opposite ends, a first axial section extending from one of said ends for a first distance and having a first inner diameter substantially equal to said stem outer diameter, a second axial section extending integrally from said first section for a second distance and having a second inner diameter larger than said first inner diameter over at least a portion of said second distance, and a third axial section extending integrally from said second section for a third axial distance to the other of said ends of said body, said first and second sections having walls not less than a predetermined thickness and said third section including at least one peripheral wall area having a thickness substantially less than said predetermined thickness; and e) means for effecting tight frictional engagement between portions of said body and the outer surface of a cable extending into said connector by radial compression of said cable in response to application of axial force sufficient to move said other end of said body toward said one end;

wherein said axial force is so related to the properties of said predetermined material and said thickness of said peripheral wall area that said axial force completely fractures said body in the area of said peripheral wall area; and wherein said means for effecting frictional engagement comprise a portion of said third section which is moved by said axial force between the inner surface of said second section and said cable outer surface subsequent to said fracture of said body.

2. The connector of claim 1 wherein said peripheral wall area is at the juncture of said second and third sections.

3. The connector of claim 2 wherein said third section includes two of said peripheral wall areas.

4. A connector for mounting to an end portion of a coaxial cable, said connector comprising:

a) a threaded nut;

b) a hollow post having integral flange and stem portions, said stem having a predetermined outer diameter over at least an axial portion adjoining said flange;

c) means for rotatably securing said nut to said post;

d) a hollow, one piece body of predetermined material having opposite ends, a first axial section extending from one of said ends for a first distance and having a first inner diameter substantially equal to said stem outer diameter, a second axial section extending integrally from said first section for a second distance and having a second inner diameter larger than said first inner diameter over at least a portion of said second distance, and a third axial section extending integrally from said second section for a third axial distance to the other of said ends of said body, said first and second sections having walls not less than a predetermined thickness and said third section including at least one peripheral wall area having a thickness substantially less than said predetermined thickness; and e) means for effecting tight frictional engagement between portions of said body and the outer surface of a cable extending into said connector by radial compression of said cable in response to application of axial force sufficient to move said other end of said body toward said one end;

wherein said axial force is so related to the properties of said predetermined material and said thickness of said peripheral wall area that said axial force fractures said body in the area of said peripheral wall area;

wherein said means for effecting frictional engagement comprises a portion of said third section which is moved by said axial force between the inner surface of said second section and said cable outer surface subsequent to said fracture of said body; and wherein said portion of said third section comprises a wall section tapering outwardly from said peripheral wall area toward said other end of said body.

5. A connector for mounting to a terminal end of a coaxial cable having a central conductor, an inner layer of dielectric material contacting and surrounding said central conductor, a layer of conducting material contacting and surrounding said inner layer of dielectric material, a layer of woven mesh shielding material contacting and surrounding said conducting material, and an outer layer of dielectric material, said connector serving to connect said cable to a port of an item of video equipment for passage of electrical signals between said cable and said port, said connector comprising:

a) first means for threaded engagement of said connector to said port;

b) second means including a hollow, substantially cylindrical post for axial insertion between said layer of conducting material and said layer of shielding material; and c) a body comprising an axially elongated, hollow wall having first and second ends, a first section extending from said first end with an inner surface defining a diameter substantially equal to the outer diameter of a first axial length of said post, said first axial length extending through and frictionally engaged with said first section inner surface, a second section integrally adjoining said first section with an inner surface defining a diameter larger than the outer diameter of a second axial length of said post, said second axial length extending through said second section in spaced relation to said second section inner surface, and a third section integrally adjoining and extending from said second section to said second end and including at least one portion movable in response to application of axial force to transmit a radially compressive force to said cable, therein effecting tight frictional engagement of said connector and said cable by movement of at least a part of said at least one movable portion between said second section inner surface and said woven mesh shielding layer.

6. The connector of claim 5 wherein said first means comprises an internally threaded nut.

7. The connector of claim 6 wherein said nut is freely rotatable with respect to said second means and said body.

8. The connector of claim 7 wherein said post comprises a stem portion which includes both said first and second axial lengths, and a flange portion formed integrally with and extending outwardly from one end of said stem portion.

9. The connector of claim 8 wherein said third section includes an inner surface defining a diameter substantially equal to said diameter of said second section inner surface.

10. The connector of claim 9 wherein said second section has a wall thickness not less than a predetermined dimension and said third section adjoins said second section at a wall section having a reduced thickness substantially less than said predetermined dimension.

11. A connector for mounting to a terminal end of a coaxial cable having a central conductor, an inner layer of dielectric material contacting and surrounding said central conductor, a layer of conducting material contacting and surrounding said inner layer of dielectric material, a layer of woven mesh shielding material contacting and surrounding said conducting material, and an outer layer of dielectric material, said connector serving to connect said cable to a port of an item of video equipment for passage of electrical signals between said cable and said port, said connector comprising:

a) first means for threaded engagement of said connector to said port;

b) second means including a hollow, substantially cylindrical post for axial insertion between said layer of conducting material and said layer of shielding material; and c) a body comprising an axially elongated, hollow wall having first and second ends, a first section extending from said first end with an inner surface defining a diameter substantially equal to the outer diameter of a first axial length of said post, said first axial length extending through and fictionally engaged with said first section inner surface, a second section integrally adjoining said first section with an inner surface defining a diameter larger than the outer diameter of a second axial length of said post, said second axial length extending through said second section in spaced relation to said second section inner surface, and a third section integrally adjoining and extending from said second section to said second end and including at least one portion movable in response to application of axial force to transmit a radially compressive force to said cable, thereby effecting tight frictional engagement of said connector and said cable;

wherein said first means comprises an internally threaded nut;

wherein said nut is freely rotatable with respect to said second means and said body;

wherein said post comprises a stem portion which includes both said first and second axial lengths, and a flange portion formed integrally with and extending outwardly from one end of said stem portion;

wherein said third section includes an inner surface defining a diameter substantially equal to said diameter of said second section inner surface;

wherein said second section has a wall thickness not less than a predetermined dimension and said third section adjoins said second section at a wall section having a reduced thickness substantially less than said predetermined dimension; and wherein said third section has a wall thickness which increases from said reduced thickness toward said second end.

12. The connector of claim 11 wherein said reduced thickness is so related to the properties of the material from which said body means is formed that said axial force causes said body means to fracture at said reduced thickness of said wall.

13. The method of mounting a connector to a prepared terminal end of a coaxial cable having an inner conductor, an inner layer of dielectric material, a conducting layer, a layer of woven mesh shielding material and an outer layer of dielectric material, said method comprising:

a) providing a post having a hollow, substantially cylindrical stem portion having a first, outer diameter, and a flange portion with a through, central opening integrally joined to and extending radially outwardly from one end of said stem portion;

b) assembling a threaded nut with said one end of said post for independent rotation with respect thereto;

c) providing an axially elongated, hollow body having first and second ends, a first section extending from said first end with a cylindrical internal surface of diameter substantially equal to said first diameter, a second section extending integrally from said first portion with a cylindrical internal surface of second diameter greater than said first diameter, and a third section extending integrally from said second section to said second end with a cylindrical internal surface of diameter substantially equal to said second diameter, said first and second sections having a wall thickness not less than a predetermined dimension and said third section including at least one peripheral area of reduced thickness;

d) assembling said post with said body by passing said stem through said first section with said first section inner surface substantially in contact with a first axial portion of said stem and said second section inner surface in spaced relation with a second axial portion of said stern;

e) inserting a prepared end of a coaxial cable into said connector from said end of said body and advancing said cable to insert a portion of said stem between said conducting layer and said shielding layer with portions of said inner dielectric layer and said conducting layer positioned within said stem and portions of said shielding layer and said outer dielectric layer positioned in the space between the outside of said stem and the inner surface of said second and third sections; and f) applying an axial force to said body causing movement of said third section in the direction of said second section between said inner surface of said second section and said shielding layer of said cable therein effecting tight frictional engagement of said connector and said cable.

14. The method of claim 13 wherein said axial force fractures said body at said peripheral area of reduced thickness.

15. The method of claim 14 wherein said peripheral area of reduced thickness is at the juncture of said second and third sections.

16. The method of claim 13 wherein said third section includes two, axially spaced peripheral areas of reduced thickness.

17. The method of claim 16 wherein portions of said third section adjacent said areas of reduced thickness are folded to a position between said inner surface of said second section and the outer surface of said outer dielectric layer of said cable in response to said axial force, thereby applying a radially compressive force to said cable and effecting said tight frictional engagement of said connector and said cable.

18. A method of mounting a connector to a prepared terminal end of a coaxial cable having an inner conductor, an inner layer of dielectric material, a conducting layer, a layer of woven mesh shielding material and an outer layer of dielectric material, said method comprising the steps of:

a) providing a post having a hollow, substantially cylindrical stem portion having a first, outer diameter, and a flange portion with a through, central opening integrally joined to and extending radially outwardly from one end of said stem portion;

b) assembling a threaded nut with said one end of said post for independent rotation with respect thereto;

c) providing an axially elongated, hollow body having first and second ends, a first section extending from said first end with a cylindrical internal surface of diameter substantially equal to said first diameter, a second section extending integrally from said first portion with a cylindrical internal surface of second diameter greater than said first diameter, and a third section extending integrally from said second section to said second end with a cylindrical internal surface of diameter substantially equal to said second diameter, said first and second sections having a wall thickness not less than a predetermined dimension and said third section including at least one peripheral area of reduced thickness;

d) assembling said post with said body by passing said stem through said first section with said first section inner surface substantially in contact with a first axial portion of said stem and said second section inner surface in spaced relation with a second axial portion of said stem;

e) inserting a prepared end of a coaxial cable into said connector from said end of said body and advancing said cable to insert a portion of said stem between said conducting layer and said shielding layer with portions of said inner dielectric layer and said conducting layer positioned within said stem and portions of said shielding layer and said outer dielectric layer positioned in the space between the outside of said stem and the inner surface of said second and third sections; and f) applying an axial force to said body causing movement of said third section in the direction of said second section and effecting tight fictional engagement of said connector and said cable;

wherein said axial force fractures said body at said peripheral area of reduced thickness.

wherein said peripheral area of reduced thickness is at the juncture of said second and third sections; and wherein the outer surface of said third section tapers outwardly from said area of reduced thickness toward said second end, and said axial force moves of a portion of said third section between said inner surface of said second section and the outer surface of said outer dielectric layer of said cable, thereby applying a radially compressive force to said cable and effecting said tight frictional engagement of said connector and cable.

19. A connector body for use with a coaxial cable connector, comprising:

a hollow, one-piece body of predetermined material having opposite ends, a first axial section extending from one of said ends for a first distance and having a first inner diameter substantially equal to an outer diameter of a stem of a hollow post which fits inside at least a portion of said first axial section, a second axial section extending integrally from said first section for a second distance and having a second inner diameter larger than said first inner diameter over at least a portion of said second distance, and a third axial section extending integrally from said second section for a third axial distance to the other of said ends of said body, said first and second sections having walls not less than a predetermined thickness and said third section including at least one peripheral wall area having a thickness substantially less than said predetermined thickness; and means for effecting tight frictional engagement between portions of said body and an outer surface of a cable extending into said body by radial compression of said cable in response to application of axial force sufficient to move said other end of said body toward said one end;

wherein said axial force is so related to the properties of said predetermined material and said thickness of said peripheral wall area that said axial force completely fractures said body in an area of said peripheral wall area; and wherein said means for effecting frictional engagement comprise a portion of said third section which is moved by said axial force between said inner surface of said second section and said cable outer surface subsequent to said fracture of said body.

20. A connector body according to claim 19, wherein said portion of said third section comprises a wall section tapering outwardly from said peripheral wall area toward said other end of said body.

21. A connector body according to claim 19, wherein said third section includes an inner surface defining a diameter substantially equal to said second inner diameter.

22. A connector body according to claim 19, wherein said third section adjoins said second section at a wall section having a reduced thickness substantially less than said predetermined dimension.

23. A connector body according to claim 19, wherein said peripheral wall area is at the juncture of said second and third sections.

24. A connector body according to claim 23, wherein said third section includes two of said peripheral wall areas.

25. A connector body for use with a coaxial cable connector, comprising:

a hollow, one-piece body of predetermined material having opposite ends, a first axial section extending from one of said ends for a first distance and having a first inner diameter substantially equal to an outer diameter of a stem of a hollow post which fits inside at least a portion of said first axial section, a second axial section extending integrally from said first section for a second distance and having a second inner diameter larger than said first inner diameter over at least a portion of said second distance, and a third axial section extending integrally from said second section for a third axial distance to the other of said ends of said body;

said first and second sections having walls not less than a predetermined thickness and said third section including at least one peripheral wall area having a thickness substantially less than said predetermined thickness;

said third section including at least one portion movable in response to application of axial force to transmit a radially compressive force to said cable, thereby effecting tight frictional engagement of said connector body to a cable;

wherein said third section includes an inner surface defining a diameter substantially equal to an inner surface of said second section;

wherein said second section has a wall thickness not less than a predetermined dimension and said third section adjoins said second section at a wall section having a reduced thickness substantially less than said predetermined dimension; and wherein said third section has a wall thickness which increases from said reduced, thickness toward said second end.

26. A connector body according to claim 25, wherein said axial force is so related to the properties of said predetermined material and said thickness of said peripheral wall area that said axial force completely fractures said body in an area of said peripheral wall area.

27. A connector body according to claim 25 wherein said reduced thickness is so related to the properties of the material from which said body means is formed that said axial force causes said body means to fracture at said reduced thickness of said wall.

28. A method of mounting a connector body to a prepared end of a coaxial cable having an inner conductor, an inner layer of dielectric material, a conducting layer, a layer of woven mesh shielding material and an outer layer of dielectric material, said method comprising the steps of:

providing a post having a hollow, substantially cylindrical stem portion having a first, outer diameter, and a flange portion with a through, central opening integrally joined to and extending radially outwardly from one end of said stem portion;

providing an axially elongated, hollow body having first and second ends, a first section extending from said first end with a cylindrical internal surface of diameter substantially equal to said first diameter, a second section extending integrally from said first portion with a cylindrical internal surface of second diameter greater than said first diameter, and a third section extending integrally from said second section to said second end with a cylindrical internal surface of diameter substantially equal to said second diameter, said first and second sections having a wall thickness not less than a predetermined dimension and said third section including at least one peripheral area of reduced thickness;

inserting said prepared end of said coaxial cable into said connector body from said end of said body and advancing said cable to insert a portion of said stem between said conducting layer and said shielding layer with portions of said inner dielectric layer and said conducting layer positioned within said stem and portions of said shielding layer and said outer dielectric layer positioned in the space between the outside of said stem and the inner surface of said second and third sections; and applying an axial force to said body causing movement of at least a portion of said third section in the direction of said second section between said inner surface of said second section and said shielding layer of said cable therein effecting tight frictional engagement of said connector and said cable.

29. A method according to claim 28, wherein:

said axial force fractures said body at said peripheral area of reduced thickness;

said peripheral area of reduced thickness is at the juncture of said second and third sections; and an outer surface of said third section tapers outwardly from said area of reduced thickness toward said second end, and said axial force moves of a portion of said third section between said inner surface of said second section and the outer surface of said outer dielectric layer of said cable, thereby applying a radially compressive force to said cable and effecting said tight frictional engagement of said connector and cable.

30. A method according to claim 28 wherein said axial force fractures said body at said peripheral area of reduced thickness.

31. A method according to claim 30 wherein said peripheral area of reduced thickness is at the juncture of said second and third sections.

32. A method according to claim 28 wherein said third section includes two, axially spaced peripheral areas of reduced thickness.

33. A method according to claim 32 wherein portions of said third section adjacent said areas of reduced thickness are folded to a position between said inner surface of said second section and the outer surface of said outer dielectric layer of said cable in response to said axial force, thereby applying a radially compressive force to said cable and effecting said tight frictional engagement of said connector and said cable.

* * * * *